United States Patent [19]

Sailors

[11] Patent Number: 4,898,291

[45] Date of Patent: Feb. 6, 1990

[54] NURSING BOTTLE WITH REMOVABLE PACIFIER

[76] Inventor: John C. Sailors, 3511 Pine St., Omaha, Nebr. 68105

[21] Appl. No.: 331,515

[22] Filed: Mar. 29, 1989

[51] Int. Cl.[4] ..... A61J 9/00

[52] U.S. Cl. ..... 215/11.4; 215/11.1; 215/11.3; 215/11.5

[58] Field of Search ..... 215/11.1, 11.2, 11.3, 215/11.4, 11.5

[56] References Cited

U.S. PATENT DOCUMENTS

| | | | |
|---|---|---|---|
| 2,813,649 | 11/1957 | Lipari | 215/11.1 |
| 2,827,191 | 3/1958 | Baracate | 215/11 |
| 2,876,773 | 3/1959 | Witz | 128/252 |
| 3,022,915 | 2/1962 | Mullin | 215/11 |
| 3,206,054 | 9/1965 | Militello | 215/11.3 |
| 3,232,466 | 2/1966 | Turanciol | 215/11 |
| 3,424,157 | 1/1969 | DiPaolo | 128/252 |
| 4,620,638 | 11/1986 | Schmidt | 215/11.1 |
| 4,640,424 | 2/1987 | White | 215/11.1 |
| 4,754,887 | 7/1988 | Ou | 215/11.4 |

FOREIGN PATENT DOCUMENTS

| | | | |
|---|---|---|---|
| 497999 | 4/1930 | Fed. Rep. of Germany | 215/11.5 |
| 460274 | 1/1937 | United Kingdom | 215/11.4 |
| 668247 | 3/1952 | United Kingdom | 215/11.4 |
| 845175 | 8/1960 | United Kingdom | 215/11.1 |
| 2067416 | 7/1981 | United Kingdom | 215/11.4 |

*Primary Examiner*—Stephen Marcus
*Assistant Examiner*—Christine A. Peterson
*Attorney, Agent, or Firm*—Zarley, McKee, Thomte, Voorhees & Sease

[57] ABSTRACT

A nursing bottle with removable pacifier includes a nursing bottle with a cap removably mounted on the upper end thereof. The cap secures a first valve assembly in place on the nursing bottle which is operable between open and closed conditions, to allow or prevent the flow of liquid from the bottle. A pacifier portion is selectively locked onto the first valve assembly. The pacifier has its own valve assembly therein which corresponds with the first valve assembly such that both valves are placed in an open condition when the pacifier is locked on the first valve assembly. The first and second valves are also cooperable such that removal of the pacifier from the first valve assembly will close both valves, such that liquid will be prevented from flowing out of the nursing bottle, and such that air will be prevented from passing through the pacifier into the nipple on the pacifier. A slide lock device is connected to the pacifier, and includes a slidable locking ring which will easily release the pacifier portion from the first valve assembly.

7 Claims, 4 Drawing Sheets

NURSING BOTTLE WITH REMOVABLE PACIFIER

TECHNICAL FIELD

The present invention relates generally to nursing bottles, and more particularly to an improved nursing bottle with a removable pacifier portion with a quick release to allow quick and easy removal from the bottle.

BACKGROUND OF THE INVENTION

Conventional nursing bottles include a nipple which is removably mounted in a cap which may be threaded onto the nursing bottle. The bottle may be filled with any desired liquid, and then the cap and nipple are threaded onto the bottle and the bottle is given to the baby.

It is common for a baby to drink less than the total amount of liquid in the bottle, but continue to use the nipple on the nursing bottle as a pacifier. The main problem with this activity is that the use of the nursing bottle nipple as a pacifier results in the baby swallowing excessive amounts of air. Excessive air swallowing frequently causes areophagia, the basic cause of colic.

To minimize this possibility, the nursing bottle should be taken from the baby once the baby has stopped feeding and should be replaced with a pacifier or the like which will not allow the baby to swallow air. Unfortunately, it is typically difficult to immediately replace the nursing bottle with a pacifier, thereby agitating the baby and causing a commotion. A similar situation occurs if the baby is still hungry and the nursing bottle is empty.

Additionally, a baby will often fall asleep with a nursing bottle resting in its mouth. When an attempt is made to remove the nursing bottle, the baby is disturbed and the sleep pattern is broken.

It is therefore a general object of the present invention to provide a nursing bottle with a combination nipple and pacifier.

Another object of the present invention is to provide a cap for a nursing bottle which allows the bottle to be removed from the cap without having to remove the nipple from the baby's mouth.

A further object of the present invention is to provide a nursing bottle with a removable cap which prevents the flow of air through the nipple when the bottle is removed from the cap.

Yet another object is to provide an improved nursing bottle with a removable pacifier portion, and a valve which prevents the flow of liquid from the bottle when removed from the pacifier portion.

Still another object of the present invention is to provide a nursing bottle with a removable pacifier portion, the pacifier portion having a valve which will prevent the flow of air therethrough when removed from the nursing bottle.

These and other objects of the present invention will be apparent to those skilled in the art.

SUMMARY OF THE INVENTION

The nursing bottle with removable pacifier of the present invention includes a nursing bottle with a cap removably mounted on the upper end thereof. The cap secures a first valve assembly in place on the nursing bottle which is operable between open and closed conditions, to allow or prevent the flow of liquid from the bottle. A pacifier portion is selectively journaled on the first valve assembly and may be locked in place thereon.

The pacifier has its own valve assembly therein which corresponds with the first valve assembly such that both valves are placed in an open condition when the pacifier is locked on to the first valve assembly. The first and second valves are also cooperable such that removal of the pacifier from the first valve assembly will close both valves, such that liquid will be prevented from flowing out of the nursing bottle, and such that air will be prevented from passing through the pacifier into the nipple on the pacifier.

A slide lock device is connected to the pacifier, and is designed to allow the pacifier portion to be journaled on to the first valve assembly and locked into position. Slidable movement of a locking ring will easily release the pacifier portion from the first valve assembly, to allow the nursing bottle to be released from the pacifier portion.

In a second embodiment of the invention, the nursing bottle has an 0-ring installed adjacent the mouth, which corresponds with an annular groove in a specially adapted cap to allow quick release of the nursing bottle from the cap. This assembly would replace the conventional threaded cap on a threaded nursing bottle.

DESCRIPTION OF THE PREFERRED EMBODIMENT

Figure 1:
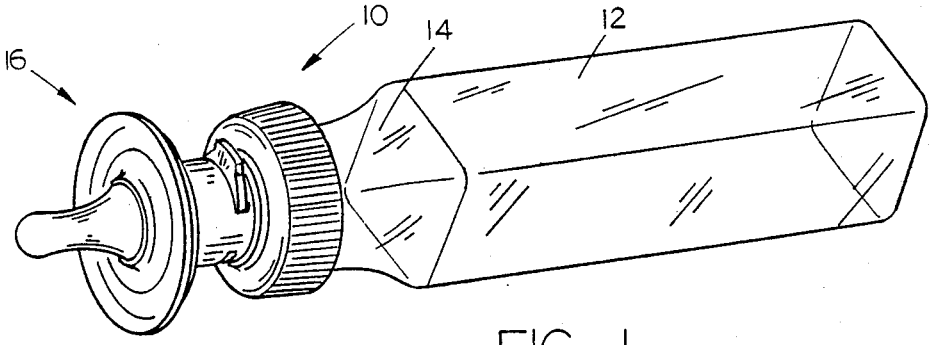
FIG. 1 is a perspective view of the nursing bottle of the present invention.
Figure 2:
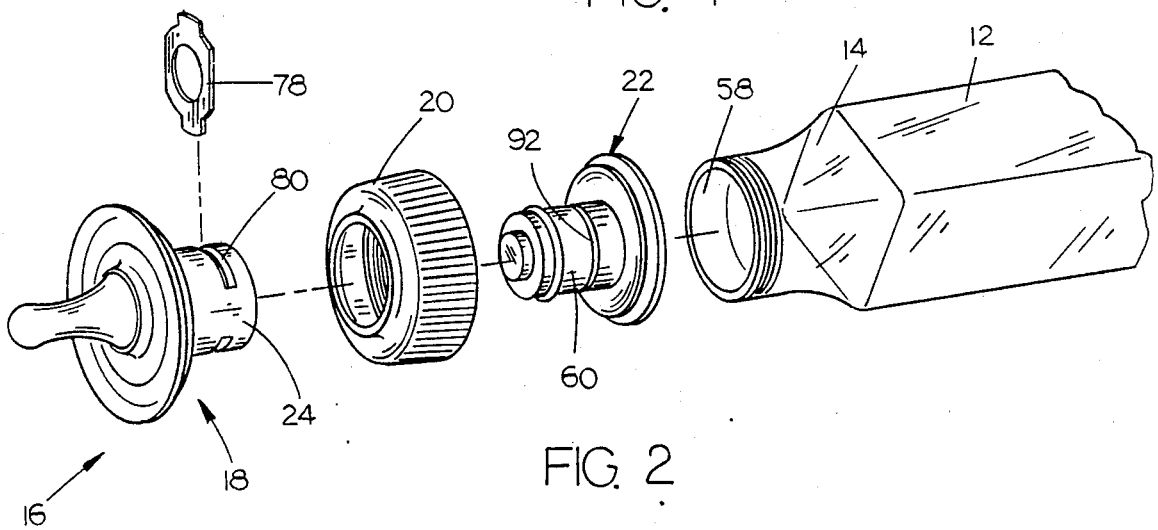
FIG. 2 is an exploded perspective view of the present invention.

Referring now to the drawings, in which identical or corresponding parts are identified with the same reference numeral, and more particularly to FIG. 1, the nursing bottle of the present invention is identified generally at 10 and includes a bottle 12 with a generally tapered upper end 14, and a removable cap assembly identified generally at 16. FIG. 2 is an exploded view of the cap assembly 16 showing the major components to be a pacifier assembly 18, a threaded cap 20 and a lower valve assembly 22, all of which are combined for mounting on the upper end 14 of bottle 12.

Figure 3:
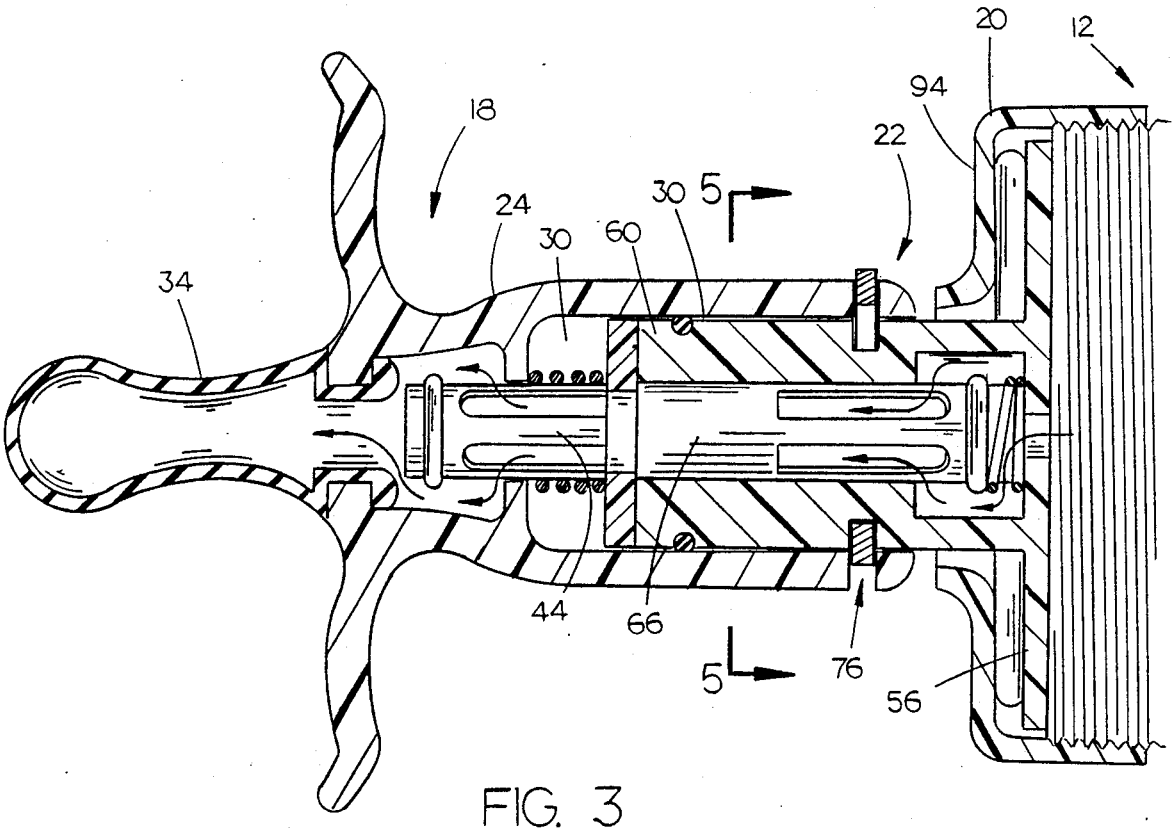
FIG. 3 is a longitudinal sectional view through the cap portion of the nursing bottle.
Figure 4:
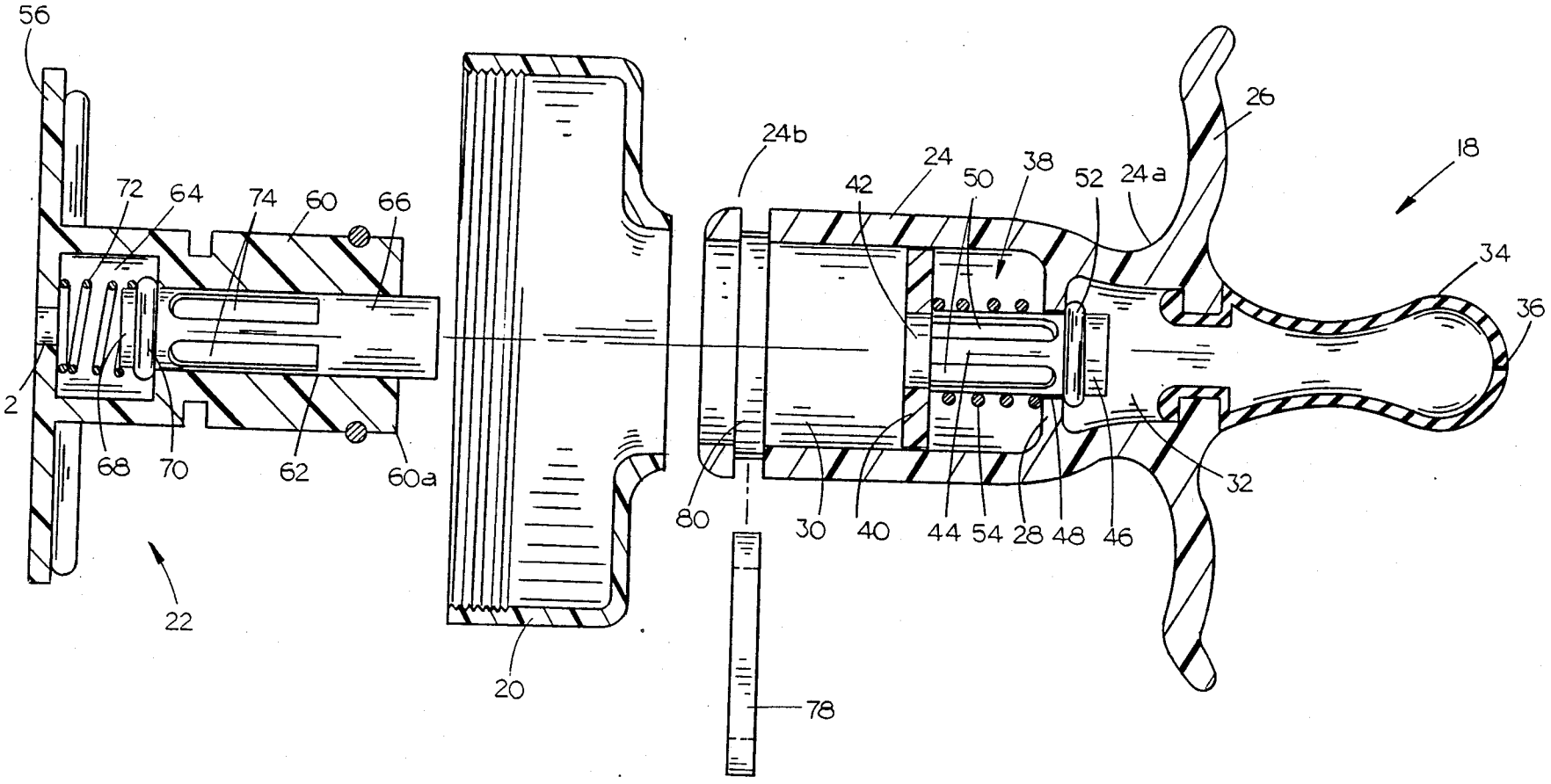
FIG. 4 is an exploded view of the view of FIG. 3.
Figure 6:
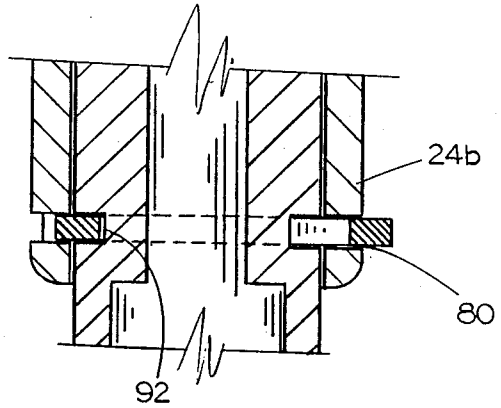
FIG. 6 is a sectional view taken at lines 6—6 in FIG. 5.
Figure 8:
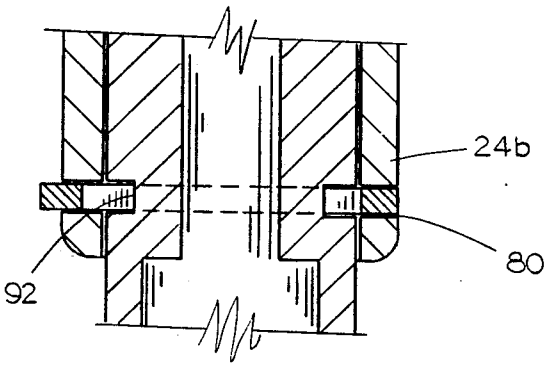
FIG. 8 is a sectional view taken at lines 8—8 in FIG. 7.

Referring now to FIGS. 2–4, pacifier assembly 18 includes a hollow, generally cylindrical, base 24 having an annular ring 26 projecting outwardly therefrom at the upper end **24*a*. A central wall 28 is formed within the hollow cylindrical base 24 so as to form a lower cavity 30 and an upper cavity 32 therein. A nipple 34 is removably attached to the upper end 24*a* of cylindrical base 24 so as to communicate with upper cavity 32, and may be constructed of conventional elastic, resilient material, such as rubber, silicon rubber or the like. Nipple 34 has an aperture 36** through which liquid within the nipple may be extracted by an infant.

An upper valve assembly is designated generally at 38 and is slidably mounted within lower cavity 30 so as to selectively allow liquid to pass from lower cavity 30 to upper cavity 32. Upper valve assembly 38 includes a generally flat disk-shaped plunger 40 having an aperture 42 centered therein to allow for the flow of liquid therethrough. A hollow valve cylinder 44 is mounted to plunger 40 with an open end in communication with aperture 42 and a closed end 46 projecting through an aperture 48 in central wall 28. A series of longitudinal slots 50 extend along the sides of hollow cylinder 44 to allow fluid to flow from aperture 42 and thence through the slots 50. An 0-ring 52 is mounted on the upper end 46 of hollow cylinder 44 so as to form a stop against movement of plunger 42 in a downward direction, as well as to seal upper cavity 32 from lower cavity 30 when upper valve assembly 38 is in the position shown in FIG. 4.

A coil spring 54 surrounds cylinder 44 and is located between central wall 28 and plunger 40 so as to bias plunger 40 away from central wall 28 into a "closed" position with slots 50 located fully within lower cavity 30.

Lower valve assembly 22 includes a flat disk-shaped base plate 56 having a diameter slightly greater than the diameter of the mouth 58 of bottle 12, so as to seal the mouth 58 closed when mounted thereon. A shaft 60 projects from plate 56 and has a hollow bore 62 completely therethrough along its longitudinal axis, such that liquid may flow therethrough. An enlarged cavity 64 is formed in bore 62 adjacent base plate 56 for a purpose described hereinbelow.

A lower valve cylinder 66 is slidably mounted within bore 62 between cavity 64 and the upper end **60*a* of cylinder 60. The lower end 68 of lower valve cylinder 66 is closed, so as to prevent the fluid from flowing therethrough. An 0-ring 70 is mounted adjacent the lower end 68 to act as a stop against one direction of slidable motion of lower valve cylinder 66. A coil spring 72 is located between end plate 66 and lower end 68 of lower valve cylinder 66 within cavity 64, so as to bias cylinder 66 upwardly, and thereby close the valve to prevent the flow of liquid. Valve cylinder 66 has a plurality of longitudinal slots 74 formed therein between 0-ring 70 and its upper end. Slots 74 are located so as to communicate with cavity 64 when valve 66 is pushed against the bias of spring 72 such that lower end 68 is moved downwardly. In this fashion, liquid can flow through bore 62 into cavity 64 into slots 74 and through the upper end of valve 66. Valve 66 projects slightly from the upper end 60*a* of shaft 60 as shown in FIG. 4, when coil spring 72** is in its expanded condition.

Referring more specifically to FIGS. 3 and 4, shaft 60 of lower valve assembly 22 has a diameter slightly less than the interior diameter of lower cavity 30 in hollow cylindrical base 24 of pacifier assembly 18. FIG. 4 shows the lower valve assembly 22 removed from pacifier portion 18, and with lower valve cylinder 66 and upper valve cylinder 44 in positions which prevent the flow of liquid therethrough. FIG. 3 shows lower valve assembly 22 journaled within pacifier portion 18, and locked in position with upper and lower valve cylinders 44 and 66 in an "open" position such that fluid may flow from nursing bottle 12 to nipple 34. It can be seen that as shaft 60 is inserted within the lower cavity 30, the projecting end of lower valve 66 will abut against plunger 40. As lower valve assembly 22 is pushed further into lower cavity 30, plunger 40 and upper valve 44 will be pushed upwardly against the bias of spring 54 and lower valve 66 will be pushed against the bias of spring 72, until slots 50 project into upper cavity 32 and until slots 74 project into bore 64, as shown in FIG. 3. A slide lock assembly 76 may then be activated to retain the lower valve assembly 22 and pacifier portion 18 in this "open" condition.

Figure 5:
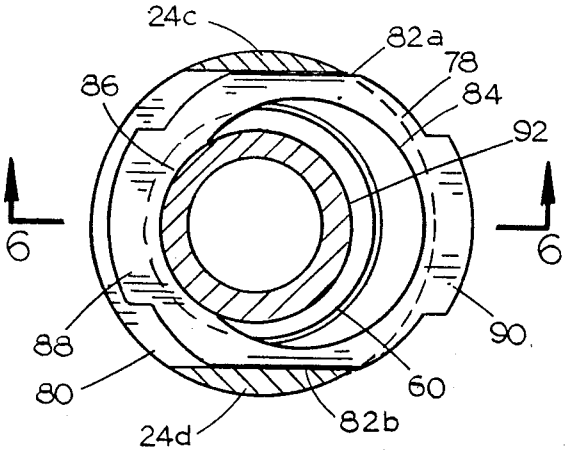
FIG. 5 is a sectional view taken at lines 5—5 in FIG. 3.
Figure 7:
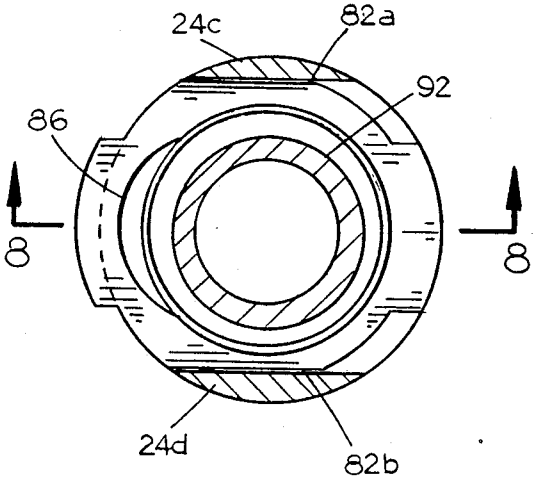
FIG. 7 is a sectional view similar to that of FIG. 5 but with the locking ring shifted into a second position.

Referring now to FIGS. 2 and 5–8, slide lock assembly 76 includes a locking ring 78 which is slidably mounted in a horizontally oriented slot 80 cut transversely through the lower end **24*b* of cylindrical base 24. Locking ring 78 has a generally circular diameter, with a pair of opposing truncated flat edges 82*a* and 82*b* which allow locking ring 78 to be journaled between walls 24*c* and 24*d* of cylindrical base 24 within slot 80. A large diameter circular aperture 84 is formed in locking ring 78, and is of a diameter slightly greater than the outside diameter of lower valve assembly shaft 60, to allow shaft 60 to slide therethrough when aligned therewith. A smaller diameter semicircular portion 86 augments large diameter aperture 84 adjacent a first tab 88 of locking ring 78. First and second tabs 88 and 90, on opposite ends of locking ring 78 allow the ring to be manually moved within slot 80. An annular channel 92 is formed in lower valve shaft 60 and has a diameter equal to the diameter of smaller aperture 86, for a close fit therewith as shown in FIG. 5**.

In operation, nursing bottle 12 may be filled with milk, or other desired liquid. Lower valve assembly 22 is then fastened to the upper end 14 of nursing bottle 12 using threaded cap 20. A shoulder 94 on threaded cap 20 will abut against base plate 56 so as to seal base plate 56 against the mouth of nursing bottle 12 in a conventional fashion. In order to attach pacifier portion 18 to lower valve assembly 22, locking ring 78 is initially inserted into slot 80 with large diameter aperture 84 centered within cylindrical base 24. Cylindrical base 24 is then inserted over shaft 60 until annular channel 92 is aligned with slot 80. Locking ring 78 is then slid from the position of FIG. 7 to the position of FIG. 5 with smaller diameter aperture 86 abutting annular channel 92. This effectively locks pacifier portion 18 in position on lower valve assembly 22, with valve cylinders 44 and 66 positioned in an "open" condition to allow liquid to flow from nursing bottle 12 to nipple 34. Once the baby is done feeding, the bottle 12 can be removed from pacifier portion 18 by shifting locking ring 78 from the position of FIG. 5 to the position of FIG. 7 and removing the lower valve assembly 22 from pacifier portion 18. It can be seen that this may be accomplished without removing pacifier portion 18 from the baby's mouth. At the same time, valve 44 and 66 will close, thereby retaining fluid within bottle 12 and preventing air from being drawn into nipple 34.

Figure 9:
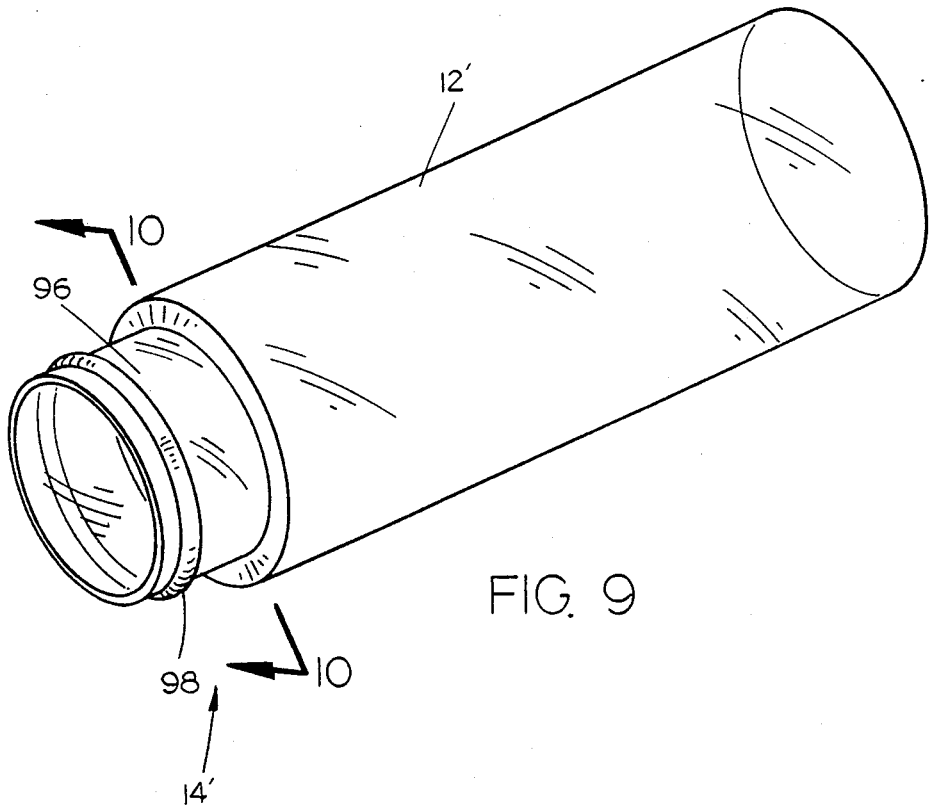
FIG. 9 is a perspective view of a second embodiment of the nursing bottle of the invention.
Figure 10:
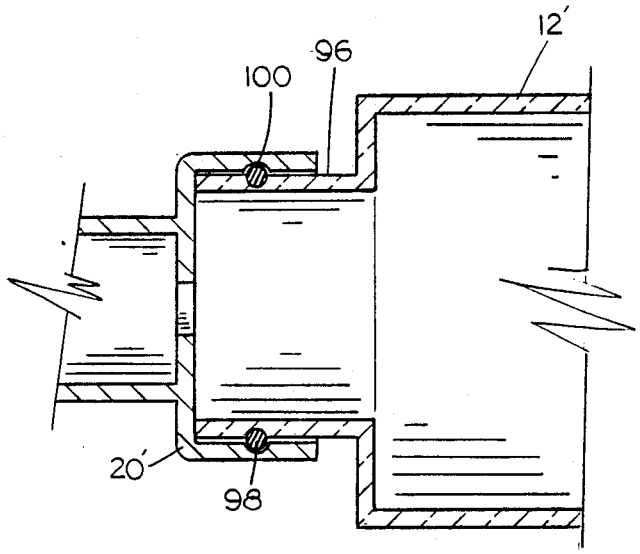
FIG. 10 is a sectional view taken at lines 10—10 in FIG. 9.

Referring now to FIGS. 9 and 10, a second embodiment of the present invention utilizes a nursing bottle 12, with a specially formed upper end 14'. Upper end 14' includes a cylindrical mouth portion 96 with an 0-ring 98 affixed thereon. Upper end 14' is adapted to fit a modified cap 20'. Cap 20' utilizes an annular notch 100 formed therein to receive 0-ring 98 in a conventional locking fashion. In this way, cap 20' may be easily removed from nursing bottle 12' by pulling on cap 20' to release the snap-lock type seal.

Whereas the invention has been shown and described in connection with the preferred embodiments thereof, it will be understood that many modifications, substitutions, and additions may be made which are within the intended broad scope of the appended claims. Thus, there has been shown and described an improved nursing bottle with removable pacifier portion which accomplishes at least all of the above-stated objects.

I claim:

1. A nursing bottle, comprising:

a bottle portion having a lower end and an open upper end;

a cap removably mounted on the upper end of said bottle portion to retain fluid therein;

said cap having a removable pacifier portion thereon;

said cap having a first valve means therein operable between an open position, wherein fluid within the bottle is allowed to flow therethrough, and a closed position, wherein fluid within the bottle is sealed therein;

said first valve means including biasing means for biasing said first valve into the closed position when said cap is removed from said pacifier portion;

said pacifier portion including a body having a bore therethrough to allow the flow of liquid;

a resilient nipple mounted on the upper end of said body, in communication with said bore, to receive fluid therein;

said nipple having a feeding opening therein;

said pacifier portion having a second valve means operably mounted within said bore and operable between an open position, wherein fluid is prevented from flow therethrough, and a closed position, wherein fluid is prevented from flowing therethrough;

said pacifier being selectively releasably connected to said cap;

said first valve means being cooperable with said second valve means such that said valve means are in the open position when said pacifier portion and cap are connected, and such that said valve means are in the closed position when said pacifier portion and cap are disconnected.

2. The nursing bottle of claim 1, further comprising selectively operable locking means on said pacifier portion, operable between a locked position preventing separation of the pacifier portion and cap, and an unlocked position allowing separation of the pacifier portion and cap.

3. The nursing bottle of claim 1, wherein said second valve means includes biasing means for biasing said second valve into the closed position when said cap is removed from said pacifier portion.

4. The nursing bottle of claim 1, wherein said cap includes means for selectively removably mounting said cap on said bottle.

5. The nursing bottle of claim 4, wherein said means for selectively removably mounting said cap on said bottle portion includes:

said upper end of said bottle portion having threads formed thereon for securement of a threaded cap; and said cap having threads formed therein cooperable with said threaded bottle for selective securement thereto.

6. The nursing bottle of claim 4, wherein said means for selectively removably mounting said cap on said bottle portion includes:

said upper end of said bottle portion having an 0-ring secured to the exterior thereof; and said cap having an annular channel formed therein cooperable with said 0-ring for selective, snappable attachment thereto, to sealably lock said cap to bottle portion.

7. A nursing bottle, comprising:

a bottle portion having a lower end and an open upper end;

a cap removably mounted on the upper end of said bottle portion to selectively retain the contents of said bottle within the bottle;

said cap having a pacifier portion selectively removably connected thereto;

said cap having a first valve means therein operable between an open position, wherein the contents of the bottle are allowed to flow through the cap, and a closed position, wherein the contents within the bottle are prevented from flowing through the cap;

said pacifier portion including a body having a bore therethrough and a resilient nipple mounted on the upper end of said body, in communication with said bore, said nipple having a feeding opening therein;

said pacifier portion having a second valve means operably mounted within said bore and operable between an open position, wherein the contents of the bottle are allowed to flow to said nipple, and a closed position, wherein the bottle's contents are prevented from flowing to said nipple;

said first valve means being cooperable with said second valve means such that both said valve means are operated to a continuously open position when said pacifier portion is connected to said cap, and cooperable such that both said valve means are operated to a continuously closed position when said pacifier portion is disconnected from said cap, whereby removal of the pacifier portion from said cap will close both said valve means and prevent the bottle's contents from flowing through the cap.

* * * * *